United States Patent [19]

Kusumoto et al.

[11] Patent Number: 4,750,016

[45] Date of Patent: Jun. 7, 1988

[54] APPARATUS FOR THE FORMATION OF IMAGES

[75] Inventors: Hiroshi Kusumoto, Wakayama; Yoshizo Kawamori, Fujiidera, both of Japan

[73] Assignee: Mita Industrial Co., Ltd., Osaka, Japan

[21] Appl. No.: 930,753

[22] Filed: Nov. 14, 1986

[30] Foreign Application Priority Data

Nov. 19, 1985 [JP] Japan ..... 60-177995[U]

[51] Int. Cl.[4] ..... G03G 15/00; B65H 29/58

[52] U.S. Cl. ..... 355/3 SH; 271/65

[58] Field of Search ..... 355/3 SH, 14 SH, 72, 355/3 R; 271/65, 186

[56] References Cited

U.S. PATENT DOCUMENTS 3,912,389 10/1975 Miyamoto ..... 355/3 R
4,147,426 4/1979 Miyoshi et al. .
4,220,323 9/1980 Smith ..... 271/65
4,365,887 12/1982 Kakitani et al. ..... 355/38 HY

*Primary Examiner*—R. L. Moses
*Assistant Examiner*—J. Pendegrass
*Attorney, Agent, or Firm*—Spencer & Frank

[57] ABSTRACT

An apparatus for the formation of images, including: paper-ejection rollers that eject recording paper on which an image has been formed with the surface facing upward, a first tray in which the recording paper ejected from the paper-ejection rollers is received with the surface facing upward, a route for turning over the recording paper, which is ejected with its face upward by the paper-ejection rollers, wherein said paper passes through the inside of the route after it is ejected by said paper-ejection rollers, a second tray in which the recording paper is received with the surface facing downward, guides that make possible the selection of either said first tray or said route for turning over the paper as the direction in which the paper ejected by said paper-ejection rollers is sent, and a switching means for switching said guides, by which the direction in which the recording paper is sent is switched between supplying of the recording paper to said first tray and to said route for turning paper over.

6 Claims, 4 Drawing Sheets

PRIOR KNOWLEDGE

APPARATUS FOR THE FORMATION OF IMAGES

BACKGROUND OF THE INVENTION

1. Field of the invention

This invention relates to an improved apparatus for the formation of images used as a laser-beam printer, electrophotographic copier, etc.

2. Description of the prior art:

It has been known that apparatuses for the formation of images are provided with a first tray and a second tray. The recording paper on which an image has been formed is ejected into the first tray with its face upward (with the surface having the formed images facing upward). The recording paper is ejected into the second tray with its face down (with the surface having the the formed images facing downward). In such image formation apparatuses, for example, as shown in FIG. 5, the second tray 106 in which the recording paper is ejected with its face downward is positioned upwards the body of the apparatus. There is a route 107 for turning paper over provided between the paper-ejection rollers 139 and the second tray 106. The recording paper is ejected by the paper-ejection rollers 139 with its face up, passes through the route 107 for turning paper over, and is thus supplied to the second tray 106. The recording paper ejected by the paper-ejection rollers 139 can also be directly supplied to the first tray 105. In the downstream direction of paper-flow past the paper-ejection rollers 139, there are guides 104. Each of the guides 104 looks like the letter L when seen from the side, and it is supported at its curved section so that it can rotate. By rotation around the curved section of each of the guides 104, it is possible to switch selectively between supplying of the recording paper to the first tray 105 and to the route 107 for turning paper over. That is, when the recording paper is ejected directly into the first tray 105, each of the guides 104 is rotated to the left (shown as a dotted outline in FIG. 5) so that the recording paper does not touch the guides 104. In contrast, when the recording paper is guided into the route 107 for turning paper over, the said guides 104 are rotated to the right (shown as the solid outline in FIG. 5) so that the leading edge of each guide 104 is near the paper-ejection rollers 139. As a result, the recording paper is sent so as to enter the route 107 for turning paper over.

In general, in image-formation apparatuses, the recording paper is readily curled by the paperejection rollers 139 when being ejected by the paperejection rollers 139. To prevent the curling of the recording paper at the time of ejection by the paperejection rollers 139, it is necessary to dispose the paper-ejection rollers 139 at as high a position as possible to thereby have the paper ejected upwards whenever possible. However, since the guides 104 are disposed near the paper-ejection rollers 139, the recording paper ejected upwards from the paper-ejection rollers 139 touches the said guides 104, so that the direction in which the recording paper is sent may be suddenly changed downwards, resulting in the curling thereof. For this reason, the guides 104 must be in as high a position as possible. However, when the recording paper is guided into the route 107 for turning paper over, it is necessary to set the leading edge of each guide 104 below the region of the ejection by the paper-ejection rollers 139, so there are boundaries within which the guides 104 must be set. Therefore, if the center of rotation 104*a* of each guide 104 is set above, then when each of the guides 104 is rotated upward so that the recording paper will have to be ejected directly into the first tray 105, the guides 104 will touch the paper-ejection rollers 139. Thus, it is not possible to set the center of rotation 104*a* of each of the guides 104 above, and it is therefore difficult to prevent the curling of the recording paper when the recording paper is sent to the first tray 105. If the center of rotation 104*a* of each of the guides 104 is set in a lower position, when the recording paper is introduced into the route 107 for turning paper over, the direction in which the recording paper is sent cannot be smoothly changed, also resulting in the curling of the recording paper.

SUMMARY OF THE INVENTION

The apparatus of this invention, which overcomes the above-discussed and numerous other disadvantages and deficiencies of the prior art, comprises paper-ejection rollers that eject recording paper on which an image has been formed with the surface facing upward, a first tray in which the recording paper ejected from the paper-ejection rollers is received with the surface facing upward, a route for turning over the recording paper while said paper passes through the inside of the route after it is ejected by said paper-ejection rollers, a second tray in which the recording paper is received with the surface facing downward, guides that make possible the selection of either said first tray or said route for turning over the paper as the direction in which the paper ejected by said paper-ejection rollers is sent, and a switching means for switching said guides, by which the direction in which the recording paper is sent is switched between supplying of the recording paper to said first tray and to said route for turning paper over.

In a preferred embodiment, when the direction in which the recording paper is sent is selected to be the direction of the first tray, by means of said guides, said switching means has said guides spaced from said paper-ejection rollers and positioned to be close to said route for turning over the paper.

In a preferred embodiment, the first tray is pivotally fixed to the body of said apparatus at its end, whereby said first tray can be set at either a first position where said first tray extends out from the body of said apparatus in the direction of ejection by said paper-ejection rollers and the recording paper is sent to said first tray with its face upward, or a second position where said first tray rotates upwards from said first position.

In a preferred embodiment, the switching means comprises cams, each of which is part of said first tray, at both ends of said first tray; a shaft that is supported on the cam surface of each of said cams and that is provided with said guides thereon; and long holes that are formed in a frame of the body of said apparatus and that are engaged with said shaft to thereby limit the movement of said shaft arising from the rotation of said first tray, whereby said cams permit said shaft to move along the long holes until said guides can be moved into the above-mentioned fixed position, with the rotation of said first tray to either the first position or the second position.

Thus, the invention described herein makes possible the object of providing an apparatus for the formation of images, that prevents the curling of the recording paper on which an image has been formed not only when the recording paper is supplied to a first tray into which the recording paper is ejected with its face upward, but also when the recording paper is supplied to a second tray into which the recording paper is ejected with its face downward.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
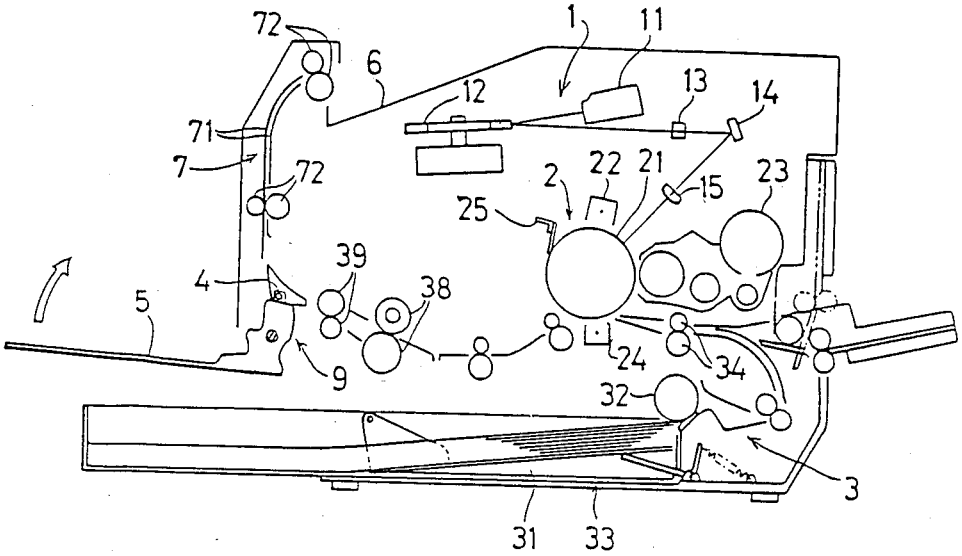
FIG. 1 is a sectional side view showing an apparatus for the formation of images of this invention.

FIG. 1 shows an apparatus for the formation of images (e.g., a laser beam printer) of this invention, which comprises an optical system 1 for the output of information about an image by means of laser light, an image-formation section 2 where a toner image formed according to the above-mentioned image information is transcribed onto recording paper, and a supply mechanism 3 for recording paper.

The optical system 1 is composed of a laser light source 11 for emitting laser light to a rotatable polyhedral mirror 12 based on image information produced by a host computer (not shown), etc., an image formation lens 13 into which reflected light is introduced from the rotatable polyhedral mirror 12, a reflecting mirror 14, and a cylindrical lens 15. The surface of a photosensitive drum 21 of the image-formation section 2 is exposed to light by the optical system 1, resulting in an electrostatic latent image thereon.

At the image-formation section 2, the surface of the photosensitive drum 21, which is rotated by a driving source (not shown), is charged uniformly with static electricity by the main electric-charge device 22, and as described above, the photosensitive drum 21 is exposed by means of a laser beam so as to form an electrostatic latent image. The latent image formed on the photosensitive drum 21 is developed by toner by a developing device 23. The resulting toner image on the photosensitive drum 21 is transcribed onto recording paper by a transcribing device 24. The toner that remains on the surface of photosensitive drum 21 is removed by a cleaning device 25.

The supply mechanism 3 for the recording paper has a cassette 31 for receiving ordinary paper; the recording paper in the said cassette 31 is sent out in succession by a paper-supply roller 32 of the automatic supply means 33, and the recording paper is supplied to the above-mentioned image-formation section 2 with predetermined timing by means of resist rollers 34. The recording paper on which the toner image is transcribed is supplied to fixing rollers 38, in which the toner image is fixed onto the recording paper. The recording paper with the fixed toner image is ejected into a first tray 5 or a second tray 6 mentioned below by the paper-ejection rollers 39.

On the side of ejection by the paper-ejection rollers 39, there are guides 4, a first tray 5, a route 7 for turning paper over, and a second tray 6.

The guides 4 are placed below the route 7 for turning paper over, and have the function of selective guidance of paper ejected from the paper-ejection rollers 39 in the direction of the first tray 5 or in the direction of the route 7 for turning paper over.

The route 7 for turning paper over has a guide-plate 71, which is nearly vertically supported, and supply rollers 72. The route 7 is opened at its bottom, and the recording paper is introduced into route 7 through this opening. The recording paper that is introduced inside is supplied in the upward direction by the supply rollers 72, running along the guideplate 71. An opening is supplied at the upper part of the said route 7 for turning paper over, with said opening facing the second tray 6, and the recording paper that is introduced inside the route 7 for turning paper over is rotated while it passes through the route 7, and ejected into the second tray 6 through the upper opening with its face downward.

Figure 2:
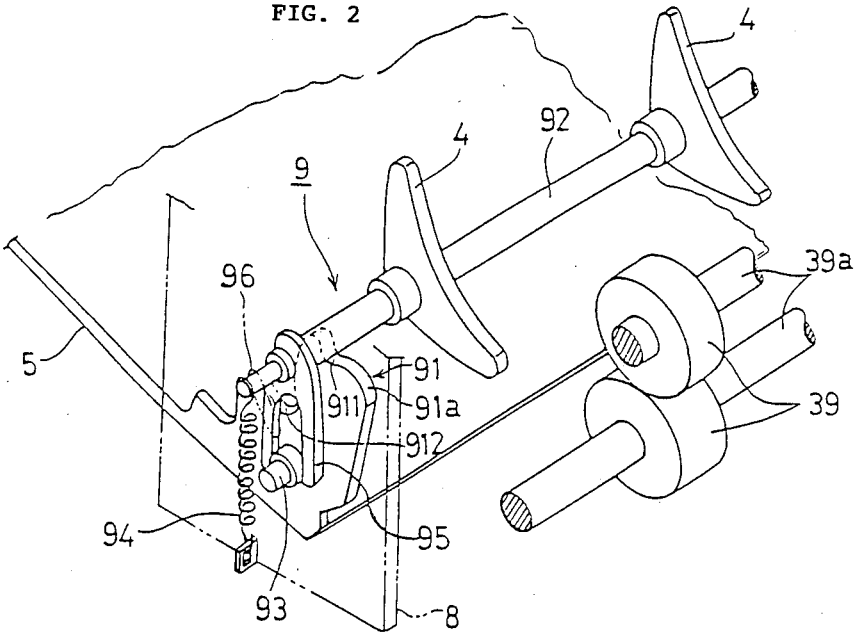
FIG. 2 is a perspective view showing a part of the apparatus shown in FIG. 1.

The first tray 5 is pivotally supported in a frame 8 of the body of the apparatus by an axis 93 on the edges of its base, as shown in FIG. 2, so that it can rotate around the axis 93. This first tray 5 can be set so as to be in either the first position in which it stretches out from the body of the apparatus in the ejection direction of the paper-ejection rollers 39 or the second position in which it rotates upward from the first position. When the first tray 5 is set at the first position, the recording paper ejected by the paper-ejection rollers 39 is placed into the said first tray 5 with its face upward.

Figure 3:
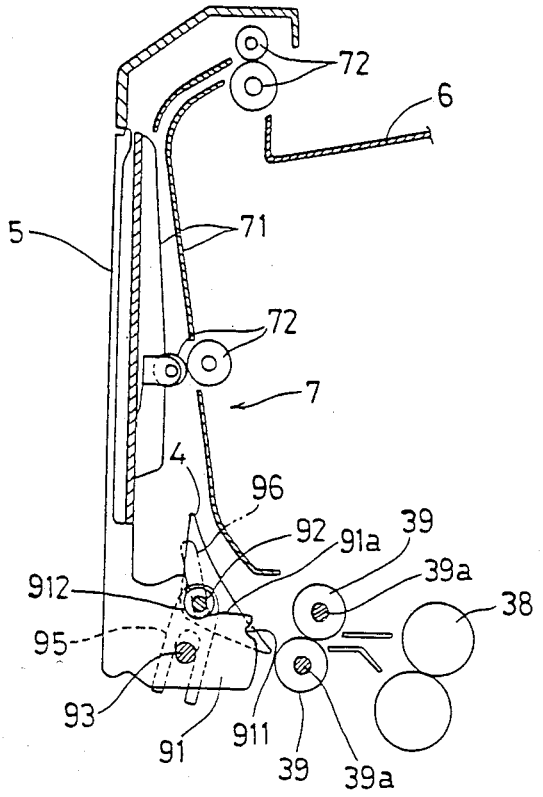
FIGS. 3 and 4 are side views showing operation of the part of the apparatus shown in FIG. 1.

The guides 4 can switch the direction of supply of the recording paper ejected by the paper-ejection rollers 39 without touching the paper-ejection rollers 39 by means of the switching means 9. In this example, by means of the switching means 9, each of the guides 4 is spaced from the paper-ejection rollers 39 and moved into a position near the above-mentioned route 7 for turning paper over when the guide 4 is set so that the direction of supply of the recording paper is selected to be the direction of the first tray 5. The switching means 9 has, as shown in FIG. 2, cams 91, each of which is part of the edge of the base of the first tray 5, and a shaft 92 that is supported on the cam surface 91*a* of the cams 91 so as to be parallel with the axis 93 around which the first tray 5 can rotate. The cam surface 91*a* has a first stable position 911 where it stably supports the shaft 92 when the first tray 5 is in the first position (FIGS. 2 and 4), and a second stable position 912 where it stably supports the shaft 92 when the first tray 5 is in the second position (FIG. 3). The above-mentioned shaft 92 is also parallel with the shafts 39*a* of the paper-ejection rollers 39, and both ends of the shaft 92 are placed so as to be able to slide in the long holes 96 formed in the frame 8. The long holes 96 are sloped so as to be gradually farther off from the paper-ejection roller 39. One end of a pulling spring 94 is fastened to, for example, one end of the shaft 92 and the other end of the pulling spring 94 is fastened to the frame 8, so that, as shown in FIG. 2 (where the first tray 5 is in the first stretched-out position), the shaft 92 can be pushed into the first stable position 911 on the cam surface 91*a* of the cam 91. The shaft 92 is furnished with a guide hook 95, which is slidably engaged with the above-mentioned axis 93 on the edges (i.e., the cam 91) of the base of the first tray 5.

The image-formation apparatus with such a structure operates as follows: When recording paper on which an image has been formed is ejected onto the second tray 6 with its face downward, so that the pages do not need rearrangement, the first tray 5 is rotated around the axis 93 upward into the second position, as shown in FIG. 3. The rotation of the first tray 5 is accomplished by the movement of the shaft 92 provided with the guides 4 thereon on the cam surface 91*a* of each of the cams 91, which is part of the first tray 5, from the first stable position 911 to the second stable position 912. Thus, the leading edge of each of the guides 4 moves somewhat downward from the region of ejection by the paper-ejection rollers 39. Then, when the recording paper with a formed image is ejected by the paper-ejection rollers 39, the recording paper is guided by the guides 4 so that it is introduced into the route 7 for turning paper over. The recording paper is then supplied to the second tray 6 with its face downward through the guide-plate 71 by conveyer rollers 72. The recording paper accumulates in order on top of the second tray 6 with its face downward.

Figure 4:
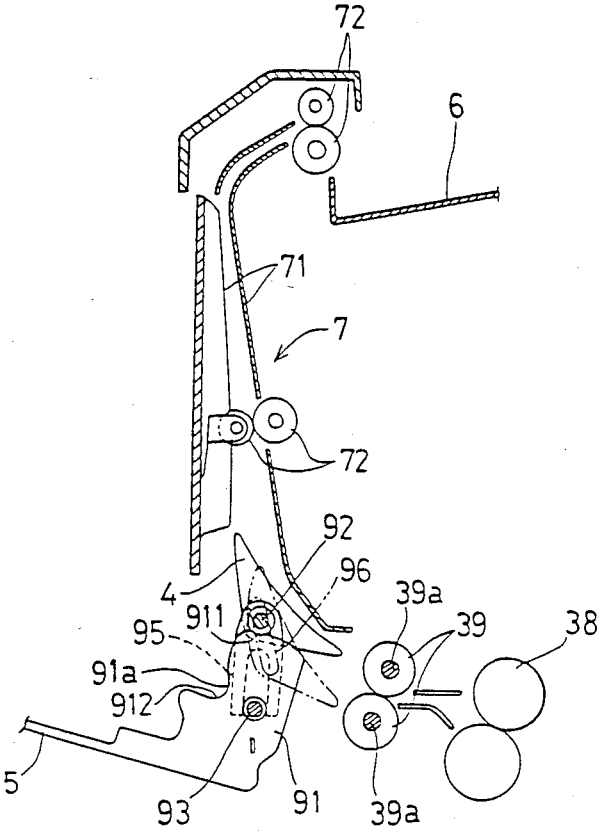
Figure 5:
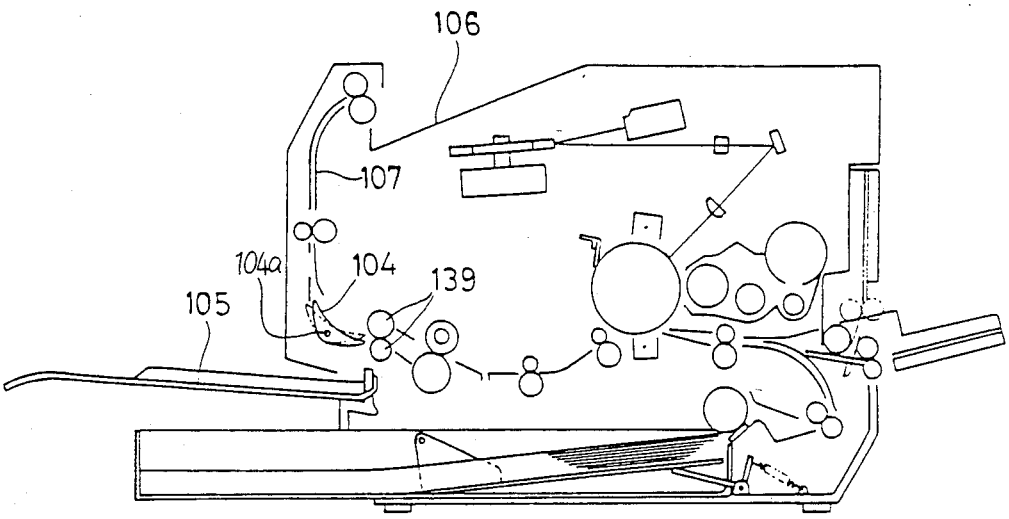
FIG. 5 is a sectional side view showing a conventional apparatus for the formation of images.

When the recording paper is ejected into the first tray 5 with its face upward so that the image formed on the paper can be checked, the first tray 5 is rotated downward around the axis 93, as shown in FIG. 4, and set into the first position, in which the first tray 5 is stretched out in the direction of ejection from the paper-ejection rollers 39. At the same time as the rotation of the first tray 5, the cams 91 also rotate, and the shaft 92 moves on the cam surface 91*a* of each of the cams 91 from the second stable position 912 to the first stable position 911 in resistance to the pulling power of the spring 94. Because the shaft 92 is engaged in the long holes 96 of the frame 8, the said shaft 92 moves upward along the long holes 96, and comes to be adjacent to the opening of the route 7 for turning paper over and also to be somewhat separated from the paper-ejection rollers 39. Each of the guides 4 furnished with the shaft 92 also moves in the same way, and is placed so that it is adjacent to the route 7 for turning paper over, and so that it is somewhat rotated in the direction away from the paper-ejection rollers 39. In this manner, the guides 4 move to an upward position where they do not touch the paper-ejection rollers 39. For that reason, the recording paper ejected by the paper-ejection rollers 39 does not touch the said guides 4, and is ejected directly into the first tray 5 with its face upward.

In the image-formation apparatus of the present invention, when the recording paper on which the image has been formed is ejected into the first tray 1 directly with its face upward, the guides move to an upward position by translational and rotational movement, where they do not touch the paper-ejection rollers, by means of a switching means. When the recording paper is instead introduced into a route for turning paper over, the guides move to a position near the paper-ejection rollers where they do not touch the paper-ejection rollers again by translational and rotational movement. Thus, the recording paper is supplied without fail in the desired supply direction. Moreover, because the guides are in a position relatively higher than that of the paperejection rollers, then even when the recording paper is introduced into the first tray, the curling of the recording paper is prevented without fail.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An apparatus for the formation of images, comprising:

paper-ejection rollers that eject recording paper with the surface facing upward on which an image has been formed, a first tray in which the recording paper ejected from the paper-ejection rollers is received with said surface facing upward, a route for turning over the recording paper while said paper passes through the inside of the route after it is ejected by said paper-ejection rollers, a second tray in which the recording paper is received with said surface facing downward, guides that make possible the selection of either said first tray or said route for turning over the paper as the direction in which the paper ejected by said paper-ejection rollers is sent, and a switching means for switching said guides, by which the direction in which the recording paper is sent is switched between supplying of the recording paper to said first tray and to said route for turning paper over, wherein when the direction in which the recording paper is sent is selected to be the direction of the first tray, by means of said guides, said switching means has said guides spaced from said paper-ejection rollers and positioned to be close to said route for turning over the paper, wherein said first tray is pivotally fixed to the body of said apparatus at its end, whereby said first tray can be set at either a first position where said first tray extends out from the body of said apparatus in the direction of ejection by said paper-ejection rollers and the recording paper is sent to said first tray with its face upward, or a second position where said first tray rotates upwards from said first position, wherein said switching means comprises at least one cam, said cam being part of said first tray.

2. An apparatus for the formation of images according to claim 1, further comprising:

a shaft supported on a cam surface of said cam and provided with said guides thereon; and long holes that are formed in a frame of the body of said apparatus and that are engaged with said shaft to thereby limit the movement of said shaft arising from the rotation of said first tray, whereby said cam permits said shaft to move along the long holes until said guides can be moved into the above-mentioned fixed position, with the rotation of said first tray to either the first position or the second position.

3. An apparatus for the formation of images, comprising:

paper-ejection rollers that eject recording paper with the surface facing upward on which an image has been formed, a first tray in which the recording paper ejected from the paper-ejection rollers is received with said surface facing upward, a route for turning over the recording paper while said paper passes through the inside of the route after it is ejected by said paper-ejection rollers, a second tray in which the recording paper is received with said surface facing downward, guides that make possible the selection of either said first tray or said route for turning over the paper as the direction in which the paper ejected by said paper-ejection rollers is sent, and a switching means for switching said guides, said switching means translating and rotating said guides relative to said paper-ejection rollers and wherein the direction in which the recording paper is sent is switched between supplying of the recording paper to said first tray and to said route for turning paper over.

4. An apparatus for the formation of images according to claim 3, wherein when the direction in which the recording paper is sent is selected to be the direction of the first tray, by means of said guides, said switching means has said guides spaced from said paper-ejection rollers and positioned to be close to said route for turning over the paper.

5. An apparatus for the formation of images according to claim 4, wherein said first tray is pivotally fixed to the body of said apparatus at its end, whereby said first tray can be set at either a first position where said first tray extends out from the body of said apparatus in the direction of ejection by said paper-ejection rollers and the recording paper is sent to said first tray with its face upward, or a second position where said first tray rotates upwards from said first position.

6. An apparatus for the formation of images according to claim 5, wherein said switching means comprises at least one cam, said cam being part of said first tray; a shaft that is supported on a cam surface of said cam and provided with said guides thereon; and long holes that are formed in a frame of the body of said apparatus and that are engaged with said shaft to thereby limit the movement of said shaft arising from the rotation of said first tray, whereby said cam permits said shaft to move along the long holes until said guides can be moved into the above-mentioned fixed position, with the rotation of said first tray to either the first position or the second position.

* * * * *